United States Patent [19]

Moomaw

[11] Patent Number: 4,701,147

[45] Date of Patent: Oct. 20, 1987

[54] TOY SIMULATED POWER DRILL WORKSHOP

[75] Inventor: David E. Moomaw, East Aurora

[73] Assignee: The Quaker Oats Company, Chicago, Ill.

[21] Appl. No.: 923,666

[22] Filed: Oct. 27, 1986

[51] Int. Cl.[4] ..... A63H 33/30

[52] U.S. Cl. ..... 446/145; 446/1; 434/260

[58] Field of Search ..... 446/145, 144, 424, 479, 446/491, 1; 434/260

[56] References Cited

U.S. PATENT DOCUMENTS 2,523,965 9/1950 Morrison ..... 446/1
2,627,698 2/1953 Wood ..... 446/145

OTHER PUBLICATIONS

"Play Drill", Playthings, Jul. 1964, vol. 62, #7, pp. 129 and 130.

*Primary Examiner*—Mickey Yu
*Attorney, Agent, or Firm*—Cumpston & Shaw

[57] ABSTRACT

A toy simulated power drill workshop is disclosed for simulating the drilling action of a real power drill in the process of drilling a hole through a board or the like. The toy simulated power drill-workshop having a base member having a first opening extending therethrough, and a plate movably mounted on the base member for covering the first opening. The plate has a second opening alignable with the first opening upon movement of the plate for uncovering the first opening. A driven gear is mounted on the plate with the teeth thereof extending into the first opening. A toy power drill having a rotatably driven cylindrical post with a drive gear on the end thereof is adapted when inserted and pressed into the first opening into engagement with the teeth to rotate the plate until the first and second openings are moved into alignment. During the rotation of the plate, the non-movement of the drill simulates the imperceptible movement of a real drill as it is drilling a hole into a board or the like. When the first and second openings are aligned, the post suddenly passes through the aligned openings simulating the sudden downward movement of a real drill when is passes completely through a board or the like.

12 Claims, 4 Drawing Figures

TOY SIMULATED POWER DRILL WORKSHOP

BACKGROUND OF THE INVENTION

1. Field of the Invention

This invention relates generally to toys, and more particularly to a toy simulated power drill workshop for simulating the drilling action of a real power drill in the process of drilling a hole through a board or the like.

2. Description of the Prior Art

Toy manufacturers are constantly challenged to make toys that more accurately and realistically mimic or correspond to adult counterparts. However, in the field of woodworking, no toys are known that simulate the slow downward movement of a real power drill in the process of drilling a hole through a board, and the sudden downward movement of the drill as it passes through the board. As a real drill is passing through a material, such as wood or metal, it moves downwardly slowly slowly due to the resistance of the material to the drill. However, when the drill passes through the board, the drill suddenly moves downwardly since resistance of the material to further downward movement of the drill is no longer present.

SUMMARY OF THE INVENTION

An object of the present invention is to provide a toy simulated power drill workshop for simulating the drilling action of a real power drill in the process of drilling a hole through a board or the like, comprising:

- a body member having a first opening extending therethrough;
- a plate movably mounted on the body member for covering the first opening, the plate having a second opening alignable with the first opening upon movement of the plate for uncovering the first opening;
- driven means mounted on the plate and having a portion thereof extending into the first opening; and
- a power drill means having a drive means on the end thereof rotatable therewith, the drive means adapted when inserted and pressed into the first opening into engagement with the portion of the drive means to move the plate until the first and second openings are aligned, and then to suddenly move through the aligned first and second openings simulating the sudden movement of a real drill when it passes completely through a board or the like.

In a more specific object of the invention, the drive means comprises a cylindrical post having a spiral groove on the periphery thereof, and the second opening has a slightly smaller diameter than the first opening so that when the first and second openings are aligned, the spiral groove follows the second opening pulling the drill through the opening.

BRIEF DESCRIPTION OF THE DRAWINGS

In the detailed description of the invention presented below, reference is made to the accompanying drawings, in which.

DETAILED DESCRIPTION OF THE INVENTION

Figure 1:
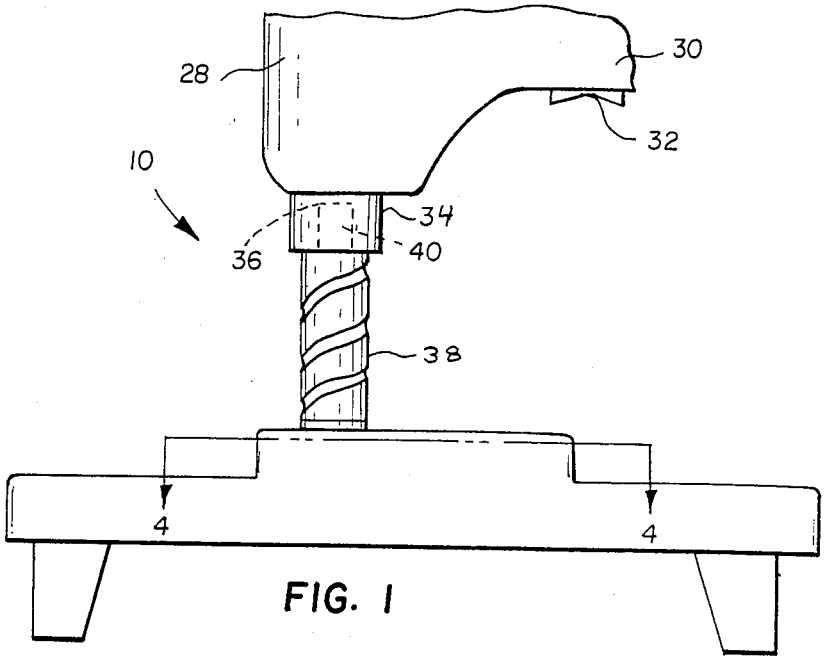
FIG. 1 is a side elevation view of a preferred embodiment of the toy simulated power drill workshop of this invention.
Figure 2:
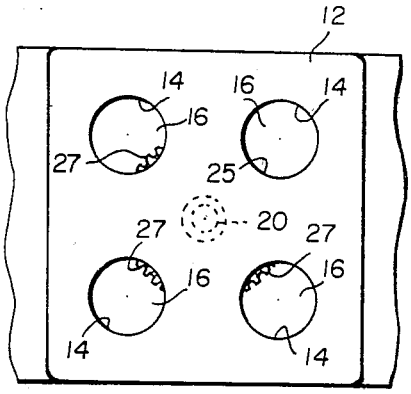
FIG. 2 is a segmental top plan view of the workshop with the simulated power drill omitted for purposes of clarity.
Figure 4:
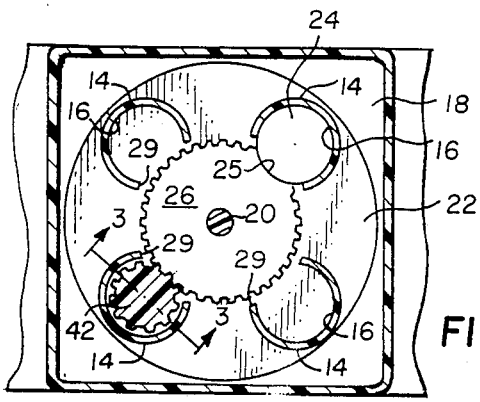
FIG. 4 is a section view taken substantially along line 4—4 of FIG. 1.

Referring now to FIGS. 1 and 2 of the drawings, a preferred embodiment of a toy simulated power drill workshop 10 of this invention comprises a base member or body 12 having a plurality of notched sleeves 14 depending from the top thereof defining a plurality of angularly spaced first openings 16 extending completely therethrough. The body 12 defines a cavity 18 for rotatably supporting spindles 20 of a circular plate 22 having a second opening 24, as best seen in FIG. 4 which is alignable with first openings 16 upon rotation of the plate. Second opening 24 further includes an arcuate segment 25 in a circular gear 26 which is integral with plate 22 and coaxial therewith. Gear 26 has teeth 27 which extend slightly into first openings 16 through notches 29 in the sleeves 14 for a purpose to be explained later.

The power drill 28 for this invention has a hollow body for receiving batteries, not shown, and a hollow handle 30 for housing a forward and reverse switch mechanism 32, which is actuatable by a child's fingers while holding the drill. The power drill 28 has a rotatable spindle 34 having a square shaped blind bore 36 for receiving corresponding square shaped ends of one or more tools, such as a socket, a screwdriver, or a cylindrical post 38 simulating a drill. The post has a square shaped connector 40 at one end and a pinion gear 42 at the other end. The post 38 has a spiral peripheral groove 44 simulating the spiral groove in a real drill bit.

Figure 3:
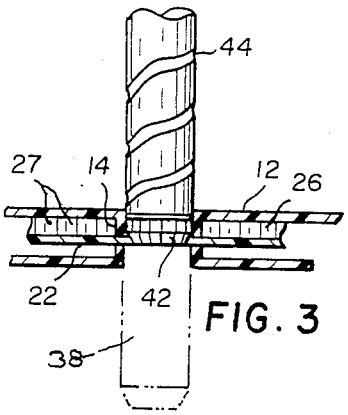
FIG. 3 is a section view taken substantially along line 3—3 of FIG. 4.

When a child wants to simulate drilling a hole through a board, for example, the square shaped connector 40 is inserted into blind bore 36 on spindle 34. The child inserts post 38 into one of the first openings 16 with pinion gear 42 guided by guide sleeve 14 into meshing engagement with the teeth 27 on circular gear 26. The switch mechanism 32 is actuated, causing post 38 to rotate, in turn rotating circular gear 26. The post and gear are prevented from moving downwardly through first opening 16 by plate 22 which covers the opening, as best seen in FIGS. 3 and 4. Continued rotation of gear 26 causes second opening 24 to uncover first opening 16 as it moves into alignment therewith, whereupon post 38 suddenly move downwardly through the aligned first and second openings 16 24 respectively, as best seen dotted in FIG. 3. This simulates the passage of a real drill through a board upon completion of the drilling of the hole.

The second opening 24 may be provided with a diameter slightly less than the diameter of first opening 16, that is a diameter substantially equal to the diameter of the post measured at the root of spiral groove 44. Accordingly, when the first and second openings 16, 24 respectively are aligned, the spiral groove on the post follows a portion of the wall defining the second opening 24 which acts as a thread for guiding the post downwardly as it turns. To retract post 38 from the openings, the child can actuate the switch mechanism 32, which backs the post out of the openings.

While a preferred embodiment of the invention has been shown and described with particularly, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy simulated power drill workshop for simulating the drilling action of a real power drill in the process of drilling a hole through a board or the like, comprising:

a body member having a first opening extending therethrough;

a plate movably mounted on the body member for covering the first opening, the plate having a second opening alignable with the first opening upon movement of the plate for uncovering the first opening;

driven means mounted on the plate and having a portion thereof extending into the first opening;

a power means having drive means on the end thereof rotatable therewith, the drive means adapted when inserted and pressed into the first opening into engagement with the portion of the driven means to move the plate until the first and second openings are aligned, and then to suddenly move through the aligned first and second openings simulating the sudden movement of a real drill when it passes completely through a board or the like.

2. The simulated toy power drill workshop according to claim 1, wherein the plate is circular and rotatably mounted on the body member.

3. The simulated toy power drill workshop according to claim 2, wherein the driven means comprises a circular gear coaxial with the plate.

4. The toy simulated power drill workshop according to claim 3, wherein the body member has a plurality of angularly spaced first openings equidistantly spaced a predetermined distance from the axis of the plate, and the first opening is also spaced a predetermined distance from the plate axis.

5. The toy simulated power drill workshop according to claim 1, wherein the power means comprises a cylindrical post having a spiral groove on the periphery thereof and a drive gear on the end thereof adapted to engage the driven means, and the second opening has a slightly smaller diameter than the first opening so that when the first and second openings are aligned, the spiral groove follows the second opening pulling the drill through the opening.

6. The toy simulated power drill workshop according to claim 5, wherein the diameter of the post measured at the root of the spiral groove is slightly less than the diameter of the second opening.

7. A toy simulated power drill workshop for simulating the drilling action of a real power drill in the process of drilling a hole through a board or the like, comprising:

a body member having a first opening extending therethrough;

a plate movably mounted on the body member for covering the first opening, the plate having a second opening alignable with the first opening upon movement of the plate for uncovering the first opening;

a power drill having a rotatable cylindrical post having drive means adjacent the end thereof rotatable therewith; and plate moving means mounted on the plate engagable with the drive means for moving the second opening into alignment with said first opening whereby when the post is inserted and pressed into the first opening and the drive means are moved into engagement with the plate moving means and the plate is moved by the power drill, the drive means and post will rapidly move through the first and second openings when they become aligned simulating the sudden movement of a real drill when it passes through a board or the like.

8. The toy simulated power drill workshop of claim 7, wherein said drive means is a first gear and said plate moving means is a second gear.

9. The toy simulated power drill workshop according to claim 8, wherein the plate moving means is a circular gear coaxial with the plate.

10. The simulated toy power drill workshop according to claim 9, wherein the body member has a plurality of angularly spaced first openings equidistantly spaced a predetermined distance from the axis of the plate, and the first opening is also spaced a predetermined distance from the plate axis.

11. The toy simulated power drill workshop according to claim 7, wherein the cylindrical post has a spiral groove on the periphery thereof, and the second opening has a slightly smaller diameter than the first opening so that when the first and second openings are aligned, the spiral groove follows the second opening pulling the drill through the opening.

12. The toy simulated power drill workshop according to claim 11, wherein the diameter of the post measured at the root of the spiral groove is slightly less than the diameter of the second opening.

* * * * *